US006836271B2

(12) United States Patent
Tezuka et al.

(10) Patent No.: US 6,836,271 B2
(45) Date of Patent: Dec. 28, 2004

(54) BOLDFACED CHARACTER-DISPLAYING METHOD AND DISPLAY EQUIPMENT EMPLOYING THE BOLDFACED CHARACTER-DISPLAYING METHOD

(75) Inventors: Tadanori Tezuka, Kaho-Gun (JP); Hiroyuki Yoshida, Kasuya-Gun (JP); Bunpei Toji, Iizuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 108 days.

(21) Appl. No.: 10/274,962

(22) Filed: Oct. 22, 2002

(65) Prior Publication Data

US 2003/0076326 A1 Apr. 24, 2003

(30) Foreign Application Priority Data

Oct. 22, 2001 (JP) ..... 2001-323439

(51) Int. Cl.[7] ..... G09G 5/26

(52) U.S. Cl. ..... 345/472.2; 345/613; 345/25; 382/301

(58) Field of Search ..... 345/472, 472.2, 345/613–614, 694, 471, 25, 23, 589; 382/298, 301

(56) References Cited

U.S. PATENT DOCUMENTS 5,821,913 A * 10/1998 Mamiya ..... 345/88
6,188,385 B1 * 2/2001 Hill et al. ..... 345/614
6,219,025 B1 * 4/2001 Hill et al. ..... 345/589
6,236,390 B1 5/2001 Hitchcock ..... 345/149
6,243,070 B1 * 6/2001 Hill et al. ..... 345/589
6,356,278 B1 * 3/2002 Stamm et al. ..... 345/611
6,542,161 B1 * 4/2003 Koyama et al. ..... 345/589

FOREIGN PATENT DOCUMENTS

JP 2001-100725 4/2001

* cited by examiner

*Primary Examiner*—Matthew C. Bella
*Assistant Examiner*—Alysa N. Brautigam
(74) *Attorney, Agent, or Firm*—Wenderoth Lind & Ponack, L.L.P.

(57) ABSTRACT

Character data to be displayed is obtained. The obtained character data is boldfaced by increasing a character line width of the obtained character data in a first direction by an amount corresponding to at least a width of a light-emitting element. A boldfaced character is displayed on a display screen in accordance with data derived from the boldfaced character data. In boldfacing the character data, a character line width-increasing pattern is selected in accordance with a degree to which the luminous intensity of the light-emitting elements contributes. In particular, the step of increasing the character line width in order to boldface the character data avoids a pattern in which a B-light (blue) emitting element is located at a next-to-endmost inner position of the increased character line width. A light-emitting pattern is selected in order to eliminate an isolated sub-pixel spot, which otherwise would objectionably be visible in the boldfaced character.

20 Claims, 9 Drawing Sheets

BOLDFACED CHARACTER-DISPLAYING METHOD AND DISPLAY EQUIPMENT EMPLOYING THE BOLDFACED CHARACTER-DISPLAYING METHOD

BACKGROUND OF THE INVENTION

1. Field of the Invention

The present invention relates to a method for displaying a character boldfaced with sub-pixel based precision, and an art related thereto.

2. Description of the Related Art

In order to display characters on a display screen, a character to be enhanced is displayed by being greater in size than the other characters. As a result, such a boldfaced character is rendered more conspicuous than the other characters.

The following describes specific implementation with reference to FIGS. 10–15 in order to provide boldfaced characters.

FIG. 10 illustrates pre-boldfaced character "A". In FIG. 10, the character "A" is displayed at a rectangular display area that consists of seven pixel rows by nine pixel columns. This character data is defined with pixel-based precision.

FIG. 11 illustrates a boldfaced character "A" that is greater in size than the character "A" of FIG. 10 by an amount of a pixel. As evidenced by FIG. 11, the character "A" has a blank objectionably blacked out at a central portion thereof. As a result, it is difficult to determine whether the boldfaced character "A" as illustrated in FIG. 11 is "A" or "Λ". Therefore, the character of FIG. 11 is improper to display as a boldfaced character.

The above example shows that a character boldfaced with pixel-based precision is likely to involve character smearing. This disadvantage is particularly noticeable when any Japanese Kanji character consisting of a large number of components is boldfaced, or alternatively when a character-displaying screen is small in size with respect to characters.

There are display devices such as a color LCD, a color plasma display, and an organic EL display, in which three light-emitting elements for illuminating different colors ("R" or red, "G" or green, and "B" or blue) are aligned with each other in a certain direction in order to form a pixel, and further which the three light-emitting elements RGB are independently controllable.

The use of such a display device allows characters to be boldfaced on a per sub-pixel basis that is greater in fineness than a pixel-by-pixel basis. Each of the light-emitting elements corresponds to a sub-pixel.

In a character zone of FIG. 10, assume that a plurality of light-emitting elements that forms each pixel is aligned with each other in a direction of x-axis. In FIG. 10, a character line width extends in the direction of x-axis. FIG. 12 illustrates a boldfaced character that is obtained by boldfacing the character of FIG. 10 with sub-pixel based precision. This example as shown in FIG. 12 is partially described in published Japanese Patent Application Laid-Open No. 2001-100725.

In FIG. 12, a character line width of the character "A" is increased by illuminating a sub-pixel next to each pixel at either end thereof in the horizontal direction of the pixels. FIG. 13 illustrates the boldfaced character of FIG. 12 in a manner similar to the way in which FIG. 11 illustrates the boldfaced character "A".

As evidenced by FIG. 13, when the character "A" is boldfaced with sub-pixel based precision, then a central blank of the boldfaced character "A" remains intact. As a result, the boldfaced character "A" is obviously identified as "A", not "A".

OBJECTS AND SUMMARY OF THE INVENTION

However, the above discussion takes no account of how much the luminous intensity of each of the light-emitting elements contributes. Three primary colors (RGB) have an intensity contribution in a RGB ratio of 3:6:1. This means that there are great differences in luminous intensity between the three primary colors. More specifically, "B" (blue) has luminous intensity as small as one sixth of that of "G" (green). Accordingly, boldfacing each character only on the basis of the above discussion brings about a problem in which a character line width appears to be partially cut away, thereby producing an isolated sub-pixel spot, with a consequential poor quality display, as detailed below.

(When a Character Line Width is Increased by an Amount of a Sub-Pixel)

FIG. 14(*a*) illustrates three light-emitting elements serially arranged in the order of RGB, in which a B-light emitting element as depicted by an arrow looks dim in brightness when compared with the remaining light-emitting elements.

FIG. 14(*b*) illustrates an additional R-light emitting element positioned rightward next to the three light-emitting elements RGB. As illustrated in the drawings of the present specification, several light-emitting elements having the signs "+" carried thereon is identified as being additionally illuminated in order to provide a boldfaced character. As illustrated in FIG. 14(*b*), when the additional R-light emitting element is illuminated in order to provide the boldfaced character, then the dim B-light emitting element located adjacent to the additional R-light emitting element isolates the additional R-light emitting element from the other light-emitting elements RG. As a result, the additional R-light emitting element is objectionably an isolated sub-pixel spot when being additionally illuminated.

As illustrated in FIG. 14(*c*), when the three light-emitting elements are aligned with each other in the order of BGR, then they are a mirror image of the light-emitting elements as illustrated in FIGS. 14(*a*) and 14(*b*). As a result, as illustrated in FIG. 14(*d*), an additional R-light emitting element next to the three light-emitting elements BGR objectionably results in an isolated sub-pixel spot when being additionally illuminated.

(When a Character Line Width is Increased by Amounts of Two Sub-Pixels)

FIG. 15(*a*) illustrates three light-emitting elements serially arranged in the order of RGB. As illustrated in FIG. 15(*b*), two additional light-emitting elements "G", "B" positioned leftward next to the three light-emitting elements RGB are illuminated in order to provide a boldfaced character. In this case, the additional B-light emitting element looks dim in brightness. As a result, the additional G-light emitting element objectionably results in an isolated sub-pixel spot when being additionally illuminated.

As illustrated in FIG. 15(*c*), when the three light-emitting elements are aligned with each other in the order of BGR, then they are a mirror image of the light-emitting elements of FIGS. 15(*a*) and 15(*b*). As a result, as illustrated in FIG. 15(*d*), an additional G-light emitting element is objectionably an isolated sub-pixel spot when being additionally illuminated.

As described above, the prior art involves the problem in which a boldfaced character has a character line width appearing to be partially broken away, thereby producing an isolated sub-pixel spot, with ensuing degradation in display quality.

In view of the above, an object of the present invention is to provide a boldfaced character-displaying method designed to display an easy-to-read boldfaced character that is provided with sub-pixel based precision without detracting from the display quality of the boldfaced character.

A first aspect of the present invention provides a boldfaced character-displaying method comprising the steps of: obtaining character data to be displayed; boldfacing the obtained character data by increasing a character line width of the obtained character data in a first direction by an amount corresponding to at least a width of a light-emitting element; and displaying a boldfaced character on a display screen of a display device in accordance with data derived from the boldfaced character data, wherein the step of boldfacing the obtained character data includes the step of selecting a character line width-increasing pattern in accordance with a degree to which the luminous intensity of the light-emitting elements contributes.

The above construction provides simple character boldfacing with sub-pixel based precision, and further inhibits isolated sub-pixel spot-caused degradation in display quality in view of how much the luminous intensity of the light-emitting elements contributes.

A second aspect of the present invention provides a boldfaced character-displaying method as defined in the first aspect of the present invention, wherein the step of boldfacing the obtained character data includes one of the steps of increasing the character line width by an amount corresponding to the width of the light-emitting element and increasing the character line width twice as large as the width of the light-emitting element.

The above construction provides a character that is boldfaced within finer limits than a per-pixel boldfaced character, and thus inhibits boldface-caused character smearing.

A third aspect of the present invention provides a boldfaced character-displaying method as defined in the first aspect of the present invention, wherein respective light-emitting elements illuminate three primary colors RGB, and are aligned with each other in one of order of RGB and that of BGR.

The above construction allows the present invention to be applied to display devices in widespread use, such as a color LCD, a plasma display, and an organic EL display.

A fourth aspect of the present invention provides a boldfaced character-displaying method as defined in the first aspect of the present invention, wherein the step of boldfacing the obtained character data includes the step of avoiding, when increasing the character line width, a pattern in which a B-light (blue) emitting element is located at a next-to-endmost inner position of the increased character line width.

The above construction eliminates an objectionable phenomenon in which a contiguously adjacent light-emitting element located outward next to the additional B-light emitting element results in an isolated sub-pixel spot.

A fifth aspect of the present invention provides a boldfaced character-displaying method as defined in the first aspect of the present invention, wherein three light-emitting elements are aligned with each other in the order of RGB to form a pixel, and wherein an additional B-light (blue) emitting element positioned leftward next to the three light-emitting elements RGB is illuminated when the character line width is increased by an amount corresponding to the width of the light-emitting element.

The above construction eliminates the occurrence of an isolated sub-pixel spot because the additional B-light (blue) emitting element is located at an endmost position of the increased character line width toward an increased portion thereof.

A sixth aspect of the present invention provides a boldfaced character-displaying method as defined in the first aspect of the present invention, wherein three light-emitting elements are aligned with each other in the order of RGB to form a pixel, and wherein additional R-light (red) and G-light (green) emitting elements positioned rightward next to the three light-emitting elements RGB are illuminated when the character line width is increased by an amount twice as large as the width of the light-emitting element.

The above construction eliminates the occurrence of an isolated sub-pixel spot at the increased character line width toward an increased portion thereof. As a result, good display quality is retained.

A seventh aspect of the present invention provides a boldfaced character-displaying method as defined in the first aspect of the present invention, wherein three light-emitting elements are aligned with each other in the order of BGR to form a pixel, and wherein an additional B-light (blue) emitting element located rightward next to the three light-emitting elements BGR is illuminated when the character line width is increased by an amount corresponding to the width of the light-emitting element.

The above construction eliminates the occurrence of an isolated sub-pixel spot because the additional B-light (blue) emitting element is located at an endmost position of the increased character line width toward an increased portion thereof.

An eighth aspect of the present invention provides a boldfaced character-displaying method as defined in the first aspect of the present invention, wherein three light-emitting elements are aligned with each other in the order of BGR to form a pixel, and wherein additional G-light (green) and R-light (red) emitting elements arranged leftward next to the three light-emitting elements BGR are illuminated when the character line width is increased by an amount twice as large as the width of the light-emitting element.

The above construction eliminates the occurrence of an isolated sub-pixel spot at the increased character line width toward an increased portion thereof. As a result, good display quality is retained.

A ninth aspect of the present invention provides a boldfaced character-displaying method as defined in the first aspect of the present invention, wherein the step of displaying a boldfaced character on a display screen includes the step of smoothing the boldfaced character data before displaying the boldfaced character on the display screen.

The above construction renders the boldfaced character easier to view.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 3(*b*) is a descriptive illustration showing a pattern to be selected;

FIG. 3(*c*) is a descriptive illustration showing a pattern to be selected;

FIG. 3(*d*) is a descriptive illustration showing a pattern to be selected;

FIG. 4(*b*) is a descriptive illustration showing a pattern to be selected;

FIG. 4(*c*) is a descriptive illustration showing a pattern to be selected;

FIG. 4(*d*) is a descriptive illustration showing a pattern to be selected;

FIG. 14(*b*) is a descriptive illustration showing a pattern to be selected according to the prior art;

FIG. 14(*c*) is a descriptive illustration showing a pattern to be selected according to the prior art;

FIG. 14(*d*) is a descriptive illustration showing a pattern to be selected according to the prior art;

FIG. 15(*b*) is a descriptive illustration showing a pattern to be selected according to the prior art;

FIG. 15(*c*) is a descriptive illustration showing a pattern to be selected according to the prior art; and FIG. 15(*d*) is a descriptive illustration showing a pattern to be selected according to the prior art.

DETAILED DESCRIPTION OF THE PREFERRED EMBODIMENTS

Figure 1:
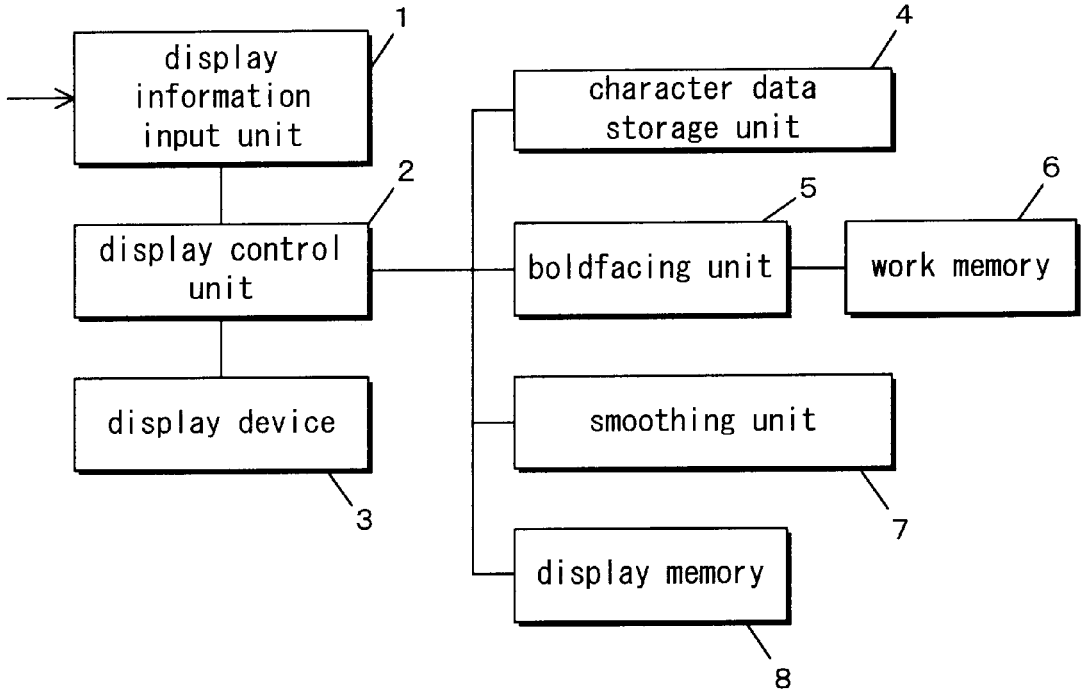
FIG. 1 is a block diagram illustrating display equipment according to an embodiment of the present invention.

An embodiment of the present invention will now be described with reference to the rawings. FIG. 1 is a block diagram illustrating display equipment according to the embodiment.

A display information input unit 1 enters information to be displayed. A display control unit 2 controls components of the display equipment as illustrated in FIG. 1.

A display device 3 includes a display screen consisting of a plurality of light-emitting elements that forms each pixel, such as a color LCD, a color plasma display, and an organic EL display. The present embodiment assumes that the respective light-emitting elements illuminate three primary colors RGB, and further that such three light-emitting elements are aligned with each other in the order of both RGB and BGR.

A character data storage unit 4 includes either a memory or a hard disc for storing character data, or rather pre-boldfaced, usual character data.

A boldfacing unit 5 boldfaces the character data that is stored in the character data storage unit 4, thereby producing the boldfaced character data. The way in which the boldfacing unit 5 boldfaces the character data is described later.

Figure 12:
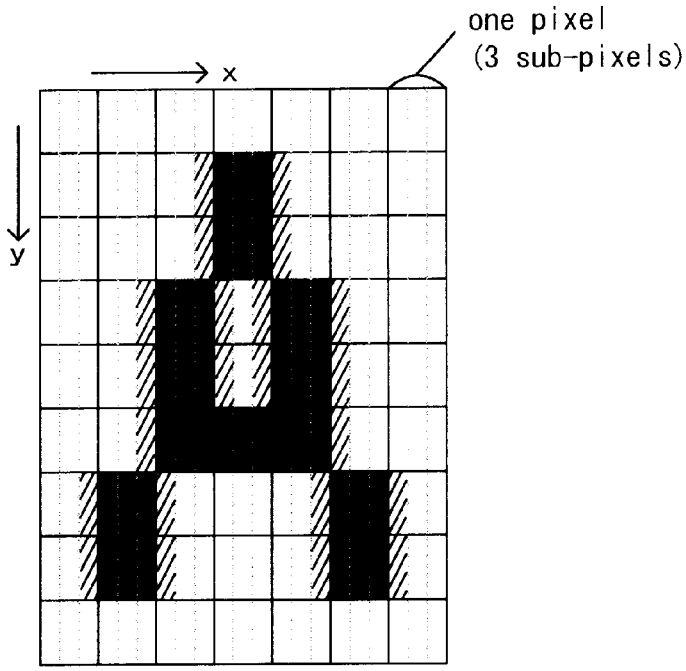
FIG. 12 is a descriptive illustration showing a prior art boldfaced character.
Figure 13:
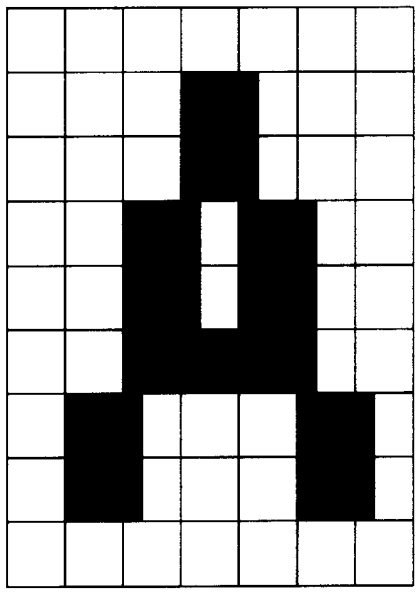
FIG. 13 is a descriptive illustration showing a prior art boldfaced character.
Figure 14A:
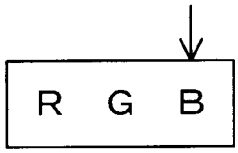
FIG. 14(*a*) is a descriptive illustration showing a pattern to be selected according to the prior art.
Figure 14B:
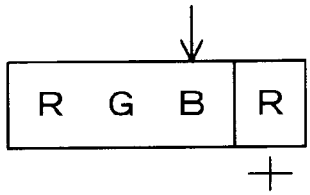
Figure 14C:
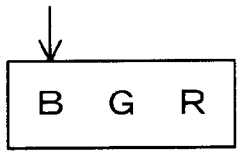
Figure 14D:
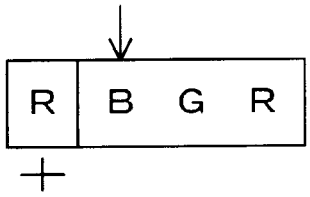
Figure 15A:
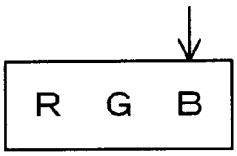
FIG. 15(*a*) is a descriptive illustration showing a pattern to be selected according to the prior art.
Figure 15B:
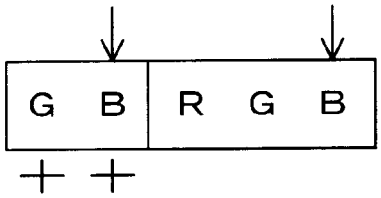
Figure 15C:
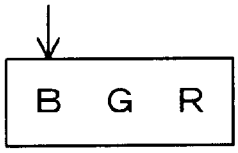
Figure 15D:
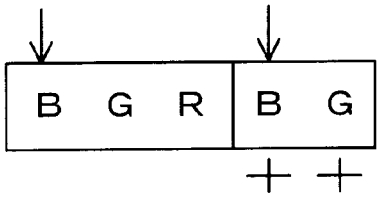

A work memory 6 is used to permit the boldfacing unit 5 to boldface the character data. The work memory 6 includes a storage area for each sub-pixel as illustrated in FIG. 12.

For convenience of description, the present embodiment assumes that the storage area contains ON-OFF binary data. However, the storage area can be expanded to contain multiple-value (e.g., eight bits) data, when necessary.

A smoothing unit 7 enters the boldfaced character data that is developed in the work memory 6 by the boldfacing unit 5, and then smoothes the boldfaced character data in order to develop display data in a display memory 8. This smoothing step preferably includes a filtering step for inhibiting color irregularities because filtered character data is easier to read.

The display memory 8 includes a VRAM or equivalent for containing raster data to be displayed on the display device 3.

Figure 2:
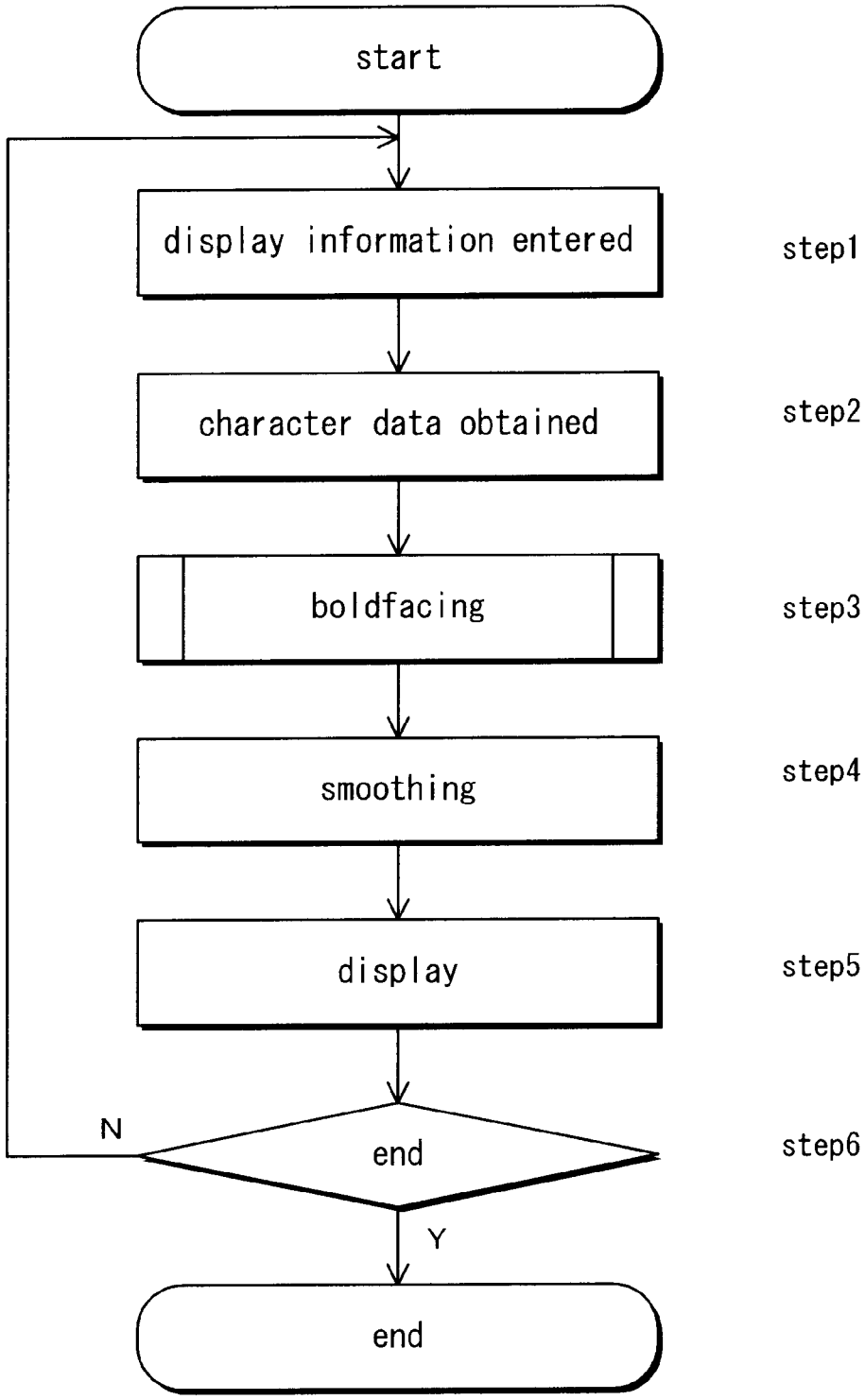
FIG. 2 is a flowchart illustrating a displaying method according to the embodiment.
Figure 3A:
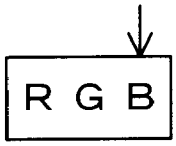
FIG. 3(*a*) is a descriptive illustration showing a pattern to be selected.
Figure 3B:
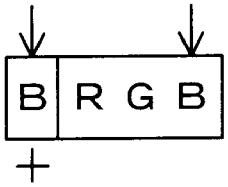
Figure 3C:
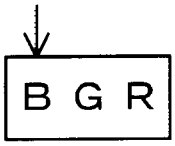
Figure 3D:
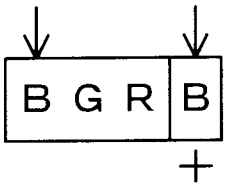
Figure 4A:
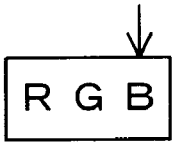
FIG. 4(*a*) is a descriptive illustration showing a pattern to be selected.
Figure 4B:
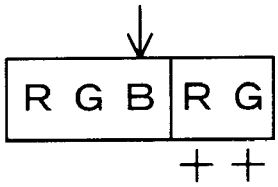
Figure 4C:
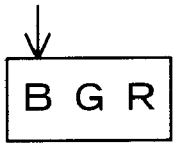
Figure 4D:
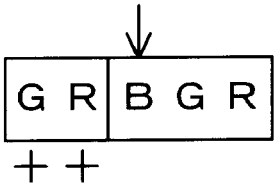

Next, a flow of processing carried out by the display control unit 2 is described with reference to FIG. 2.

At step 1, the display information input unit 1 enters display information. The display information herein refers to any display information to be boldfaced, but may include other display information as well. At step 2, the display control unit 2 searches the character data storage unit 4, and then obtains character data as illustrated in, e.g., FIG. 10. The obtained character data corresponds to an entered character.

At step 3, the display control unit 2 delivers the character data to the boldfacing unit 5, and then instructs the boldfacing unit 5 to boldface the delivered character data. The boldfacing unit 5 boldfaces the delivered character data in response to the instructions from the boldfacing unit 5. The way in which the boldfacing unit 5 boldfaces the character data is described later. The boldfaced character data is developed in the work memory 6.

At step 4, the boldfaced character data developed in the work memory 6 is carried to the smoothing unit 7 from the work memory 6. The smoothing unit 7 smoothes the boldfaced character data in a predetermined manner in order to develop the results in the display memory 8.

At step 5, the display control unit 2 drives the display device 3 to display a boldfaced character in accordance to the raster data developed in the display memory 8. When the routine is non-terminated at step 6, then the display control unit 2 repeats the processing of steps 1 to 6.

Next, patterns to be selected when the boldfacing unit 5 boldfaces the character data are described with reference to FIGS. 3–9.

(When a Character Line Width is Increased by an Amount of a Sub-Pixel)

When three light-emitting elements that form a pixel are aligned with each other in the order of RGB as illustrated in FIG. 3(*a*), then the boldfacing unit 5 illuminates an additional light-emitting element "B" positioned leftward adjacent to the three light-emitting elements RGB, as illustrated in FIG. 3(*b*).

Figure 6:
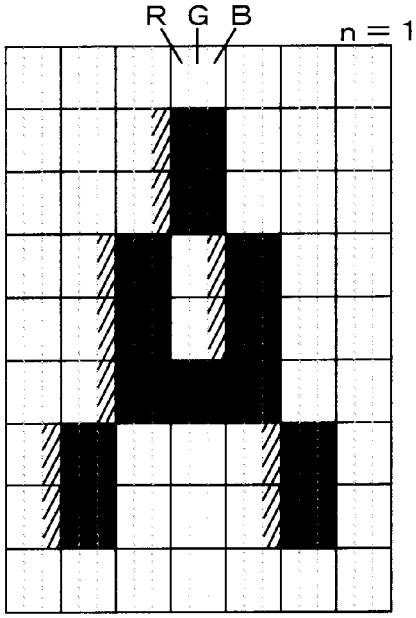
FIG. 6 is a descriptive illustration showing a boldfaced character.

In this instance, the two dim light-emitting elements "B's" are positioned at both ends of the above alignment. This arrangement eliminates the occurrence of an isolated sub-pixel spot, thereby providing boldfaced character data as illustrated in FIG. 6.

When three light-emitting elements that form a pixel are aligned with each other in the order of BGR as illustrated in FIG. 3(*c*), then the boldfacing unit 5 illuminates an additional light-emitting element "B" positioned rightward next to the three light-emitting elements BGR, as illustrated in FIG. 3(*d*).

Figure 7:
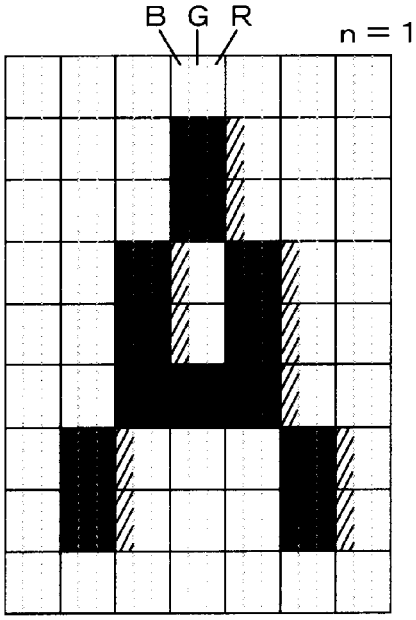
FIG. 7 is a descriptive illustration showing a boldfaced character.

As a result, the two dim light-emitting elements "B's" are located at both ends of the above alignment. This arrangement eliminates an isolated sub-pixel spot, thereby providing boldfaced character data as illustrated in FIG. 7.

(When a Character Line Width is Increased by Amounts of Two Sub-Pixels)

When three light-emitting elements that form a pixel are aligned with each other in the order of RGB as illustrated in FIG. 4(*a*), then the boldfacing unit 5 illuminates two additional light-emitting elements "R", "G" arranged rightward next to the three light-emitting elements RGB, as illustrated in FIG. 4(*b*).

Figure 8:
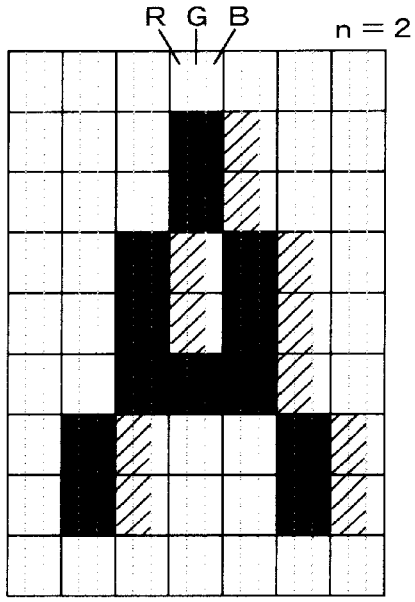
FIG. 8 is a descriptive illustration showing a boldfaced character.

The illuminated additional light-emitting elements "R", "G" increases a character line width. As a result, the additional light-emitting element "R", not "B", is located at a next-to-endmost inner position of the increased character line width toward an increased portion thereof. This arrangement eliminates an isolated sub-pixel spot. This feature provides boldfaced character data as illustrated in FIG. 8.

When three light-emitting elements that form a pixel are aligned with each other in the order of BGR as illustrated in FIG. 4(*c*), then the boldfacing unit 5 illuminates two additional light-emitting elements "G", "R" located leftward next to the three light-emitting elements BGR, as illustrated in FIG. 4(*d*).

Figure 9:
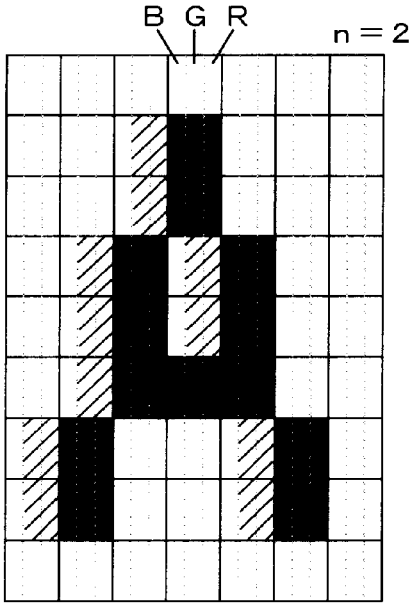
FIG. 9 is a descriptive illustration showing a boldfaced character.

The illuminated additional light-emitting elements "G", "R" increases a character line width. As a result, the additional light-emitting element "R", not "B", is located at a next-to-endmost inner position of the increased character line width toward an increased portion thereof. This arrangement eliminates an isolated sub-pixel spot. This feature provides boldfaced character data as illustrated in FIG. 9.

The above selection is made according to a rule that avoids locating the light-emitting element "B" (blue) at a next-to-endmost inner position of the increased character line width. Any selection according to the rule is encompassed by the present invention. For example, the present invention is also applicable when any light-emitting elements other than the three light-emitting elements RGB are added, or alternatively when the three-light emitting elements that form a pixel are aligned with each other in any order other than the sequence of both RGB and BGR.

Figure 5:
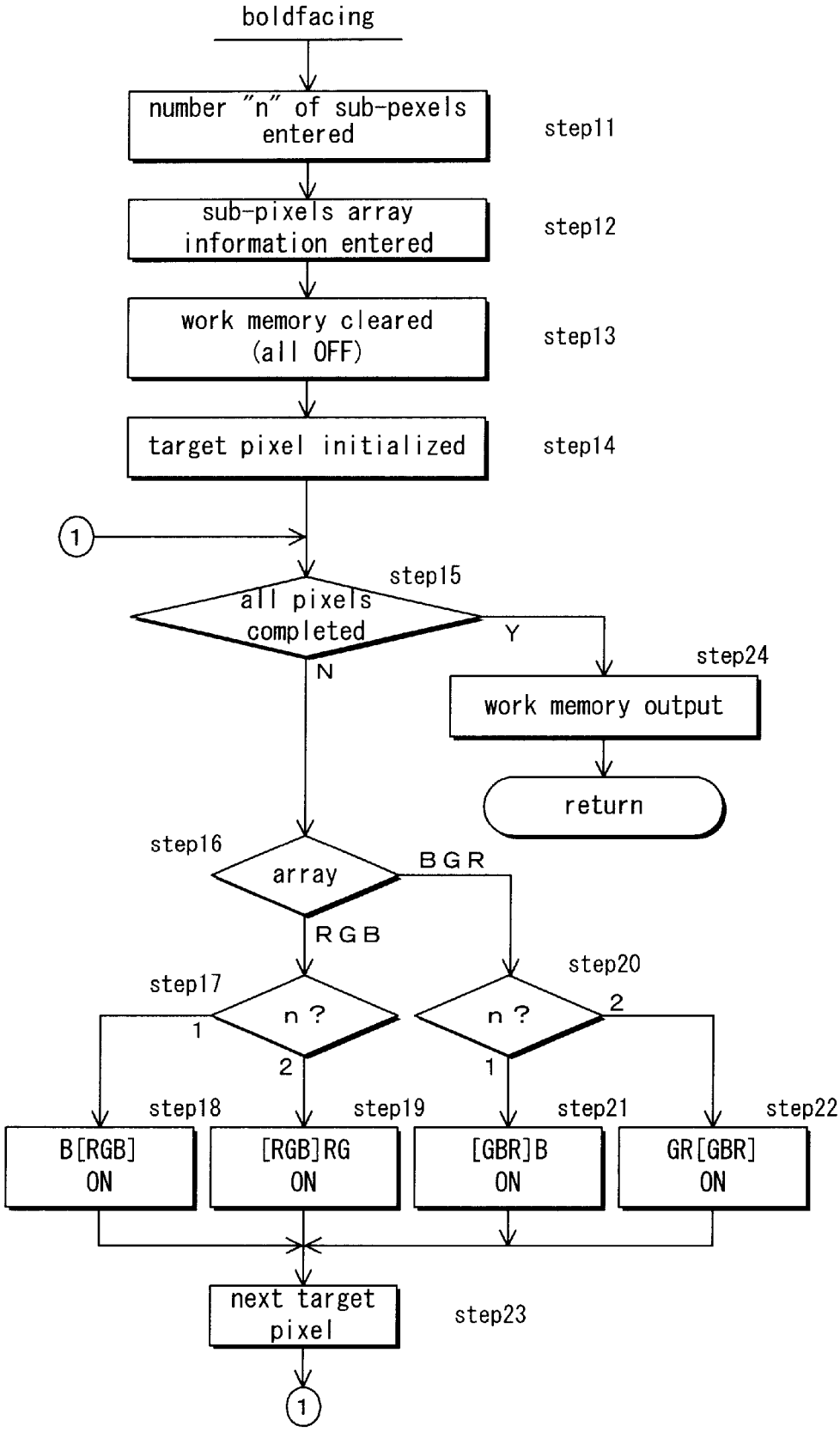
FIG. 5 is a flowchart illustrating how a boldfaced character is provided.

In view of the above pattern selection, a flow of boldfacing conducted by the boldfacing unit 5 is now described with reference to FIG. 5.

At step 11, the display control unit 2 enters the number "n" of sub-pixels into the boldfacing unit 5 in order to increase a character line width. The number "n" is equal to either one or two.

The display control unit 2 enters information into the boldfacing unit 5 on how the light-emitting elements are aligned within the range of each pixel in the display device 3. In the present embodiment, the light-emitting elements are aligned in the order of either RGB or BGR. The routine is advanced to the next step 13 when the above input is terminated.

At step 13, the boldfacing unit 5 initializes all of the storage areas of the work memory 6, thereby driving them into an "OFF" state. As previously discussed, each of the storage areas corresponds to a sub-pixel.

At step 14, the boldfacing unit 5 defines, e.g., an upper-left pixel (a pixel indexed by x, y-axis values of zero in FIG. 10) as a target pixel.

Figure 10:
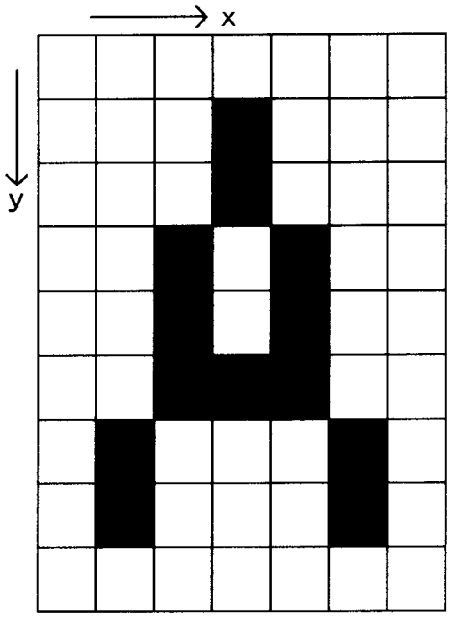
FIG. 10 is a descriptive illustration showing how a boldfaced character is provided according to the prior art.
Figure 11:
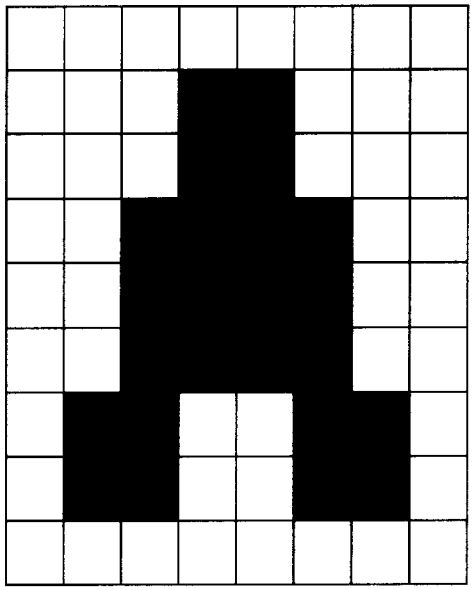
FIG. 11 is a descriptive illustration showing a prior art boldfaced character.

At step 15, the boldfacing unit 5 checks, e.g., a pixel determined by a x-axis value of six and a y-axis value of eight in FIG. 10, in order to ascertain that not all pixels have been processed as the target pixel. At steps 16 to 22, the boldfacing unit 5 boldfaces character data in accordance with the above-described rule (see FIGS. 3 to 4).

In the steps 18, 19, 21, and 22, characters enclosed by brackets such as [RGB] and [BGR] show the respective colors of three light-emitting elements that form a pixel, while characters enclosed by no brackets such as B, RG, GR shows the respective colors of light-emitting elements that are added during the boldfacing step. The term "ON" refers to a step of turning a storage area of the work memory 6 "ON", which corresponds to each of the sub-pixels as named at steps 18, 19, 21, and 22.

While defining every pixel as a target pixel at step 23, the boldfacing unit 5 repeats the processing of steps 16 to 22 until the processing for all of the pixels is completed at step 15.

When the processing for all of the pixels is terminated at step 15, then at step 24, the boldfacing unit 5 delivers the boldfaced character data to the smoothing unit 7 from the work memory 6.

As described above, the present embodiment avoids character smearing, which otherwise would inevitably occur when characters are boldfaced with pixel-based precision. In addition, the present embodiment inhibits the occurrence of an isolated sub-pixel spot that is objectionably visible in the prior art boldfaced character. As a result, the present embodiment retains good display quality.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A bold-faced character-displaying method comprising:

aligning a plurality of light-emitting elements with each other in a sequence to form a pixel, each light-emitting element of the pixel being operable to illuminate a color different from the other light-emitting elements of the pixel;

aligning a plurality of the pixels with each other in a first direction to form a line;

aligning a plurality of the lines with each other in a second direction perpendicular to the first direction, thereby forming a display screen;

obtaining character data to be displayed, the character data being bitmap data;

boldfacing the obtained character data by increasing a character line width of the obtained character data in the first direction by an amount corresponding to at least a width of one of the plurality of light-emitting elements; and displaying a boldfaced character on the display screen in accordance with data derived from the bold-faced character data, wherein said boldfacing the obtained character data includes selecting a character line width-increasing pattern in accordance with a luminous intensity of each of the light-emitting elements of the pixel.

2. A boldfaced character-displaying method as defined in claim 1, wherein said boldfacing the obtained character data includes one of increasing the character line width by an amount corresponding to the width of the one of the plurality of light-emitting elements and increasing the character line width to a width that is twice as large as the width of the one of the plurality of light-emitting elements.

3. A boldfaced character-displaying method as defined in claim 1, wherein said aligning a plurality of light-emitting elements comprises one of aligning, in order, a red, a green and a blue light-emitting element and aligning, in order, a blue, a green and a red light-emitting element.

4. A boldfaced character-displaying method as defined in claim 1, wherein said boldfacing the obtained character data includes avoiding a pattern in which a blue light-emitting element is located at a next-to-endmost inner position of the increased character line width when increasing the character line width.

5. A boldfaced character-displaying method as defined in claim 1, wherein said aligning a plurality of light-emitting elements comprises aligning in order, a red, a green and a blue light-emitting element to form a pixel, and wherein an additional blue light-emitting element positioned adjacent to the red light-emitting element is illuminated when the character line width is increased by an amount corresponding to the width of the one of the plurality of light-emitting elements.

6. A boldfaced character-displaying method as defined in claim 1, wherein said aligning a plurality of light-emitting elements comprises aligning in order, a red, a green and a blue light-emitting element to form a pixel, and wherein an additional red light-emitting element positioned adjacent to the blue light-emitting element and an additional green light-emitting element positioned adjacent to the additional red light-emitting element are illuminated when the character line width is increased by an amount twice as large as the width of the one of the plurality of light-emitting elements.

7. A boldfaced character-displaying method as defined in claim 1, wherein said aligning a plurality of light-emitting elements comprises aligning, in order, a blue, a green and a red light-emitting element to form a pixel, and wherein an additional blue light-emitting element positioned adjacent to the red light-emitting element is illuminated when the character line width is increased by an amount corresponding to the width of the one of the plurality of light-emitting elements.

8. A boldfaced character-displaying method as defined in claim 1, wherein said aligning a plurality of light-emitting elements comprises aligning, in order, a blue, a green and a red light-emitting element to form a pixel, and wherein an additional green light-emitting element positioned adjacent to the blue light-emitting element and an additional red light-emitting element positioned adjacent to the additional green light-emitting element are illuminated when the character line width is increased by an amount twice as large as the width of one of the plurality of light-emitting elements.

9. A boldfaced character-displaying method as defined in claim 1, wherein said displaying a boldfaced character on the display screen comprises smoothing the boldfaced character data before displaying the boldfaced character on the display screen.

10. A boldfaced character-displaying method as defined in claim 1, wherein said aligning a plurality of lines comprises forming a display screen on an LCD.

11. A bold-faced character-displaying apparatus comprising:

a display device comprising a plurality of lines aligned with each other in a first direction thereby forming a display screen, each of said lines comprising a plurality of pixels aligned with each other in a second direction perpendicular to the first direction, each of said pixels comprising a plurality of light-emitting elements aligned with each other in a certain sequence, each light-emitting element of each pixel being operable to illuminate a color different from the other light-emitting elements of said each pixel;

a display memory operable to store data to be displayed on said display device;

a character data storage unit operable to store character data to be displayed, the character data being bitmap data;

a boldfacing unit operable to boldface the character data stored in said character data storage unit, said boldfacing unit being operable to increase a character line width of the character data in the second direction by an amount corresponding to at least a width of one of said light-emitting elements; and a display control unit operable to store data in said display memory in accordance with data derived from the boldfaced character data and to display a boldfaced character on said display screen, wherein said boldfacing unit is operable to select a character line width-increasing pattern in accordance with a luminous intensity of each of the light-emitting elements of the pixel.

12. A boldfaced character-displaying apparatus as defined in claim 11, wherein said boldfacing unit is further operable to perform one of increasing the character line width by an amount corresponding to the width of one of said light-emitting elements and increasing the character line width twice as large as the width of said one of said light-emitting elements.

13. A boldfaced character-displaying apparatus as defined in claim 11, wherein each of said pixels comprises, aligned in order, a red, a green and a blue light-emitting element.

14. A boldfaced character-displaying apparatus as defined in claim 11, wherein said boldfacing unit is operable to avoid a pattern in which a blue light-emitting element is located at a next-to-endmost inner position of the increased character line width when increasing the character line width.

15. A boldfaced character-displaying apparatus as defined in claim 11, wherein each of said pixels comprises, aligned in order, a red, a green and a blue light-emitting element, and wherein said boldfacing unit is operable to illuminate an additional blue light-emitting element positioned adjacent to said red light-emitting element when said boldfacing unit increases the character line width by an amount corresponding to the width of one of said light-emitting elements.

16. A boldfaced character-displaying apparatus as defined in claim 11, wherein each of said pixels comprises, aligned in order, a red, green and blue light-emitting element, and wherein said boldfacing unit is operable to illuminate an additional red light-emitting element arranged adjacent to said blue light-emitting element and an additional green light-emitting element arranged adjacent to said additional red light-emitting element when said boldfacing unit increases the character line width by an amount twice as large as the width of one of said light-emitting elements.

17. A boldfaced character-displaying apparatus as defined in claim 11, wherein each of said pixels comprises, aligned in order, a blue, a green and a red light-emitting element, and wherein said boldfacing unit is operable to illuminate an additional blue light-emitting element positioned adjacent to said red light-emitting element when said boldfacing unit increases the character line width by an amount corresponding to the width of one of said light-emitting elements.

18. A boldfaced character-displaying apparatus as defined in claim 11, wherein each of said pixels comprises, aligned in order, a blue, a green and a red light-emitting element, and wherein said boldfacing unit is operable to illuminate an additional green light-emitting element arranged adjacent to said blue light-emitting element and an additional red light-emitting element arranged adjacent to said additional green light-emitting element when said boldfacing unit increases the character line width by an amount twice as large as the width of one of said light-emitting elements.

19. A boldfaced character-displaying apparatus as defined in claim 11, further comprising a smoothing unit operable to smooth the boldfaced character data before the boldfaced character data is fed into said display memory.

20. A boldfaced character-displaying apparatus as defined in claim 11, wherein said display device is an LCD.

* * * * *